US012449184B1

(12) United States Patent
Wang et al.

(10) Patent No.: US 12,449,184 B1
(45) Date of Patent: Oct. 21, 2025

(54) REFRIGERATOR DOOR WITH REPLACEABLE DOOR PANEL

(71) Applicants: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

(72) Inventors: Wenchun Wang, Qingdao (CN); Hao Zhang, Qingdao (CN); Enpin Xia, Qingdao (CN); Tong Xu, Qingdao (CN)

(73) Assignees: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 371 days.

(21) Appl. No.: 18/013,226

(22) PCT Filed: Jun. 18, 2021

(86) PCT No.: PCT/CN2021/100880
§ 371 (c)(1),
(2) Date: Dec. 27, 2022

(87) PCT Pub. No.: WO2022/001697
PCT Pub. Date: Jan. 6, 2022

(30) Foreign Application Priority Data

Jun. 30, 2020 (CN) ..... 202010623430.4

(51) Int. Cl.
*F25D 23/02* (2006.01)

(52) U.S. Cl.
CPC ..... *F25D 23/028* (2013.01); *F25D 2400/18* (2013.01)

(58) Field of Classification Search
CPC .... F25D 23/02; F25D 23/028; F25D 2201/12; F25D 2400/18; E05B 65/0042
See application file for complete search history.

(56) References Cited

U.S. PATENT DOCUMENTS 3,402,578 A * 9/1968 Atkinson ..... E05B 65/5253 292/199
3,642,164 A * 2/1972 O'Neal ..... F25D 23/00 49/495.1

(Continued)

FOREIGN PATENT DOCUMENTS

CN 2447706 Y 9/2001
CN 101131282 A * 2/2008

(Continued)

*Primary Examiner* — James M Ference
(74) *Attorney, Agent, or Firm* — Cheng-Ju Chiang

(57) ABSTRACT

A refrigerator door with a replaceable door panel includes a foam door body and a decorative panel detachably connected to the foam door body; a press latch and a limiter are disposed on the foam door body; a first hook and a second hook opposed to each other are disposed on a rear side of the decorative panel facing towards the foam door body, a lock hole being disposed on the first hook; wherein when the decorative panel is assembled to a front side of the foam door body, a front end of the press latch catches the lock hole to limit a displacement of the decorative panel in an up-down direction; the second hook engages the limiter to limit a displacement of the decorative panel in a front-rear direction.

19 Claims, 8 Drawing Sheets

(56) References Cited

U.S. PATENT DOCUMENTS 3,708,997 A * 1/1973 McLaughlin ..... F25D 19/00 62/298
5,007,226 A * 4/1991 Nelson ..... F25D 23/02 52/784.15
8,366,221 B2 * 2/2013 Kim ..... F25D 23/02 312/405
8,439,461 B2 * 5/2013 Kim ..... F25D 23/02 312/405
8,567,885 B2 * 10/2013 Lee ..... E05D 7/0027 312/405
9,435,579 B1 * 9/2016 House ..... E05D 7/081
10,823,483 B1 * 11/2020 Baylor ..... F25D 23/028
2002/0066258 A1 * 6/2002 Oishi ..... F25D 23/02 52/784.15
2004/0182103 A1 9/2004 Jung
2007/0188059 A1 * 8/2007 Davis ..... F24C 15/045 312/265.6
2008/0252186 A1 * 10/2008 Crompton ..... F25D 23/10 312/204
2008/0278049 A1 * 11/2008 Park ..... E05F 5/00 29/890.035
2008/0297019 A1 * 12/2008 Kim ..... F25D 23/02 312/405
2008/0303400 A1 * 12/2008 Kim ..... F25D 23/02 312/401
2009/0009043 A1 * 1/2009 Gwak ..... E05C 1/145 312/405.1
2009/0045705 A1 * 2/2009 Laible ..... A47B 96/20 312/204
2010/0287975 A1 * 11/2010 Lim ..... F25D 23/02 62/449
2010/0295425 A1 * 11/2010 Kim ..... F25D 27/00 428/210
2010/0327720 A1 * 12/2010 Pae ..... F25D 23/028 49/70
2011/0089790 A1 * 4/2011 Lee ..... F25D 23/02 29/890.035
2012/0169196 A1 * 7/2012 Marchetti ..... E06B 5/006 312/265.6
2013/0033163 A1 * 2/2013 Kang ..... F25D 23/04 312/405.1
2013/0164483 A1 * 6/2013 Cites ..... B32B 3/04 428/68
2013/0323461 A1 * 12/2013 Shim ..... B32B 3/08 264/510
2016/0117022 A1 * 4/2016 Kim ..... F24C 15/02 345/82
2016/0178277 A1 * 6/2016 Park ..... H03K 17/962 345/173
2018/0164026 A1 * 6/2018 Lee ..... A47F 3/0434
2018/0164031 A1 * 6/2018 Lee ..... F25D 11/00
2018/0164033 A1 * 6/2018 Lee ..... F25D 29/005
2018/0172337 A1 * 6/2018 Choi ..... A47F 3/043
2018/0274846 A1 * 9/2018 Kim ..... F25D 23/025
2018/0274852 A1 * 9/2018 Kang ..... F25D 23/025
2020/0326119 A1 * 10/2020 Lee ..... F25D 23/02
2021/0071935 A1 * 3/2021 Lee ..... F25D 23/02
2023/0251020 A1 * 8/2023 Li ..... F25D 23/028 49/501
2023/0251021 A1 * 8/2023 Li ..... F25D 23/028 49/501
2023/0251022 A1 * 8/2023 Li ..... F25D 23/028 49/501
2023/0251023 A1 * 8/2023 Li ..... F25D 23/02 312/401
2023/0251024 A1 * 8/2023 Wang ..... F25D 23/02
2023/0258385 A1 * 8/2023 Wang ..... F25D 23/028 49/501
2023/0258386 A1 * 8/2023 Wang ..... F25D 23/028
2023/0280084 A1 * 9/2023 Wang ..... F25D 23/028
2023/0314061 A1 * 10/2023 Li ..... F25D 23/028 312/401
2023/0324104 A1 * 10/2023 Li ..... F25D 23/02 312/405

FOREIGN PATENT DOCUMENTS

CN 101131291 A * 2/2008
CN 102620503 A * 8/2012
CN 102980356 A 3/2013
CN 103499176 A 1/2014
CN 104457115 A 3/2015
CN 206420220 U 8/2017
CN 107187349 A 9/2017
CN 207763338 U 8/2018
CN 210119057 U * 2/2020
DE 2922384 A1 * 12/1980
DE 19840416 A1 * 3/2000 ..... F25D 29/005
EP 0647821 A1 * 4/1995
JP 2006-46793 A 2/2006
WO 2014/024429 A1 2/2014

* cited by examiner

REFRIGERATOR DOOR WITH REPLACEABLE DOOR PANEL

CROSS REFERENCE TO RELATED APPLICATIONS

The present application is a 35 U.S.C. § 371 National Phase conversion of International (PCT) Patent Application No. PCT/CN2021/100880, filed on Jun. 18, 2021, which claims the priority of Chinese Application No. 202010623430.4 filed on Jun. 30, 2020, the disclosure of which is incorporated by reference herein. The PCT International Patent Application was filed and published in Chinese.

TECHNICAL FIELD

The present invention relates to the technical field of household appliances, and particularly to a refrigerator door with a replaceable door panel.

BACKGROUND

Along with constant development of science and technology, a refrigerator has already become one of indispensable household appliances. In current application, as the user's demands increase, the refrigerator is also required to exist as a decoration in the household environment in addition to as a household appliance; before buying the refrigerator, the user usually has many requirements for the refrigerator such as color and pattern, and a single appearance of the refrigerator affects the user's buying demands. In addition, since a service life of the refrigerator may usually be in a range of 8 years to 10 years, during use of the refrigerator by the user, the appearance of the refrigerator once bought cannot satisfy the user's demands for long-term adjustment as the environment and scenario change.

Therefore, a refrigerator door with a replaceable door panel solves the problem about replacement of the door panel of the refrigerator door, but the decorative door panel after the replacement has a risk of breakage due to instable fixation, which affects the use of the refrigerator and is not conducive in satisfying the consumer's demands.

SUMMARY

An object of the present invention is to provide a refrigerator door with a replaceable door panel, which is capable of satisfying the replacement of a decorative panel on a front side of the refrigerator door, and meanwhile ensuring the engagement stability of the decorative panel and the foam door body in a plurality of directions.

In order to achieve one of the above object, an embodiment of the present invention provides a refrigerator door with a replaceable door panel, wherein the refrigerator door comprises:

- a foam door body, and a decorative panel detachably connected to the foam door body;
- a press latch and a limiter are disposed on the foam door body;
- a first hook and a second hook opposed to each other are disposed on a rear side of the decorative panel facing towards the foam door body, a lock hole being disposed on the first hook;
- wherein when the decorative panel is assembled to a front side of the foam door body, a front end of the press latch catches the lock hole to limit a displacement of the decorative panel in an up-down direction; the second hook engages the limiter to limit a displacement of the decorative panel in a front-rear direction.

As an optional embodiment, wherein the press latch comprises a button assembly, a first locking hook and a second locking hook, wherein when the button assembly is in an unpressed state, the first locking hook interlocks with the second locking hook, and a front end of the first locking hook is locked in the lock hole.

As an optional embodiment, wherein when the button assembly is in a pressed state, the second locking hook and the first locking hook are unlocked, and the front end of the first locking hook disengages from the lock hole.

As an optional embodiment, wherein the foam door body comprises a peripheral trim strip, a receiving hole is disposed in the peripheral trim strip, and the button assembly is received in the receiving hole; wherein the button assembly comprises a button portion and a push rod portion, and the button portion is exposed from the receiving hole.

As an optional embodiment, wherein the button portion comprises a stop, a receiving groove is disposed in the receiving hole, wherein when the button assembly is in the unpressed state, the stop is received in the receiving groove.

As an optional embodiment, wherein the button assembly comprises an elastic member, the elastic member is sleeved outside the push rod portion and received in the receiving hole, wherein a resisting portion protrudes from an interior of the receiving hole, and opposite ends of the elastic member elastically abut against the button portion and the resisting portion, respectively.

As an optional embodiment, wherein a box is also disposed in the foam door body, an opening portion is disposed on a side of the box facing towards the receiving hole, the opening portion is communicated with the receiving hole, and the first locking hook and the second locking hook are assembled in a receiving space in an interior of the box.

As an optional embodiment, wherein a lower end of the first hook comprises an extension portion which is opposite to the decorative panel in the front-rear direction, and the lock hole is disposed on the extension portion; wherein the hook is inserted through the opening portion into the receiving space in the up-down direction, and the lock hole is locked with the front end of the first locking hook.

As an optional embodiment, wherein a hook-catching groove is disposed at a rear end of the first locking hook, a hook is disposed at a front end of the second locking hook, and a lever portion extends at a rear end of the second locking hook; when the button assembly is in the unpressed state, the hook catches the hook-catching groove, and the first locking hook interlocks with the second locking hook; when the button assembly is in the pressed state, the push rod portion pushes against the lever portion, the hook disengages from the hook-catching groove, and the first locking hook and the second locking hook are unlocked.

As an optional embodiment, wherein when the button assembly is in the pressed state, the push rod portion pushes against an end face of the lever portion in parallel with the lever portion.

As an optional embodiment, wherein a front end of the first locking hook comprises a notched slot, the notched slot has opposite first arm portion and second arm portion, wherein the hook pushes down the first arm portion, and the second slot wall arm portion catches the lock hole.

As an optional embodiment, wherein a first rotating shaft is disposed between the first locking hook and a side wall of the box in the foam door body, a first torsion spring is disposed on the first rotating shaft, wherein the first torsion spring drives the first locking hook to rotate about the first rotating shaft, and the second arm portion disengages from the lock hole; and a second rotating shaft is disposed between the second locking hook and the box, a second torsion spring is disposed on the second rotating shaft, the second torsion spring drives the second locking hook to rotate about the second rotating shaft, and the hook catches the hook-catching groove.

As compared with the prior art, the present invention provides a refrigerator door with a replaceable door panel. With the latch assembly and the limiting member in the foam door body engaging the two differently-structured hooks on the rear side of the decorative panel respectively, the displacement of the decorative panel in the up-down direction and front-rear direction is limited simultaneously; since screws are not used for fixation, and instead the simple engagement structures are employed, the assembling between the decorative panel and the foam door body is stabler, the risk of the breakage of the decorative panel is smaller, and meanwhile the detachment is simpler and more convenient.

DETAILED DESCRIPTION

Figure 1:
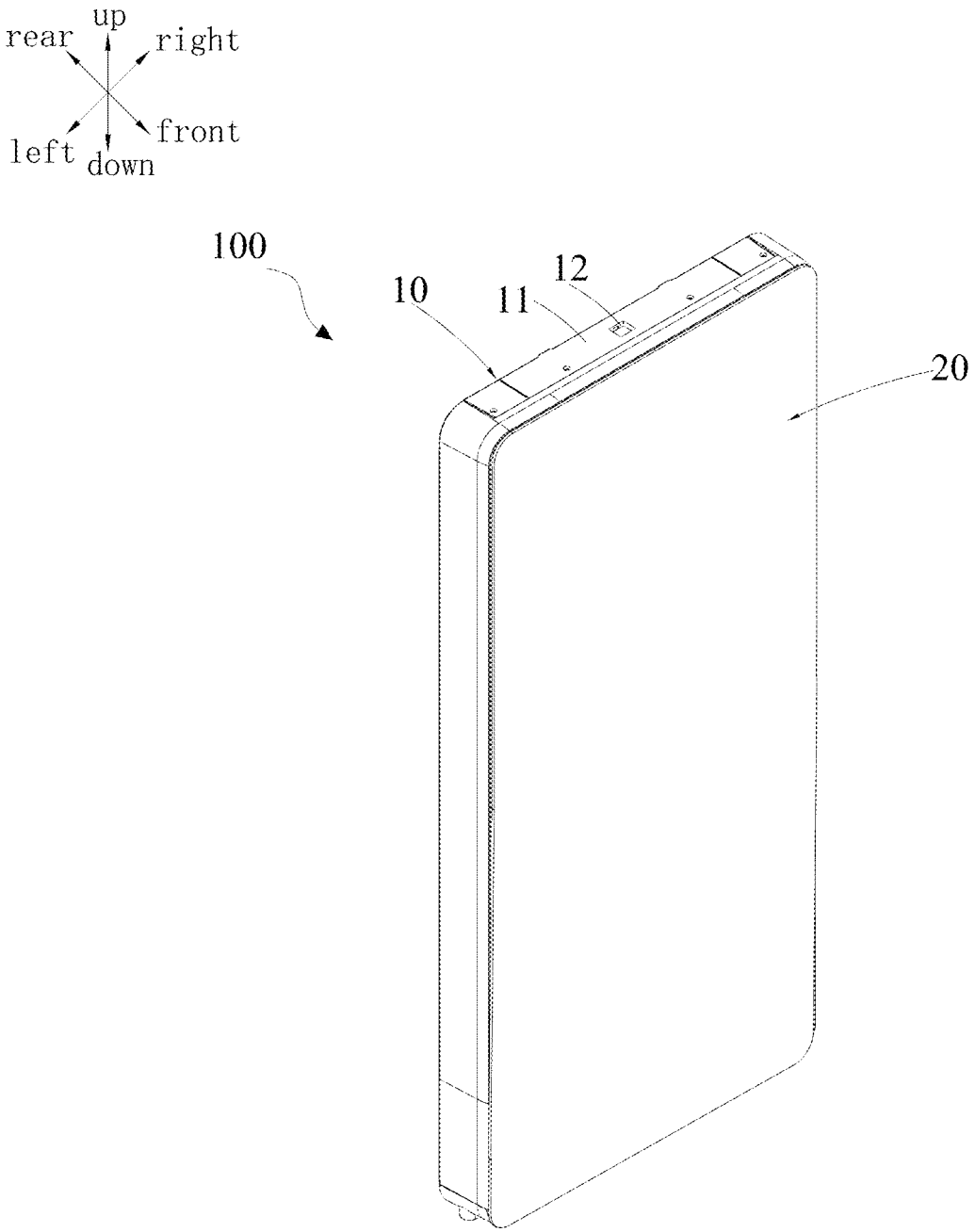
FIG. 1 is a view of a refrigerator door with a replaceable door panel according to the present invention.
Figure 2:
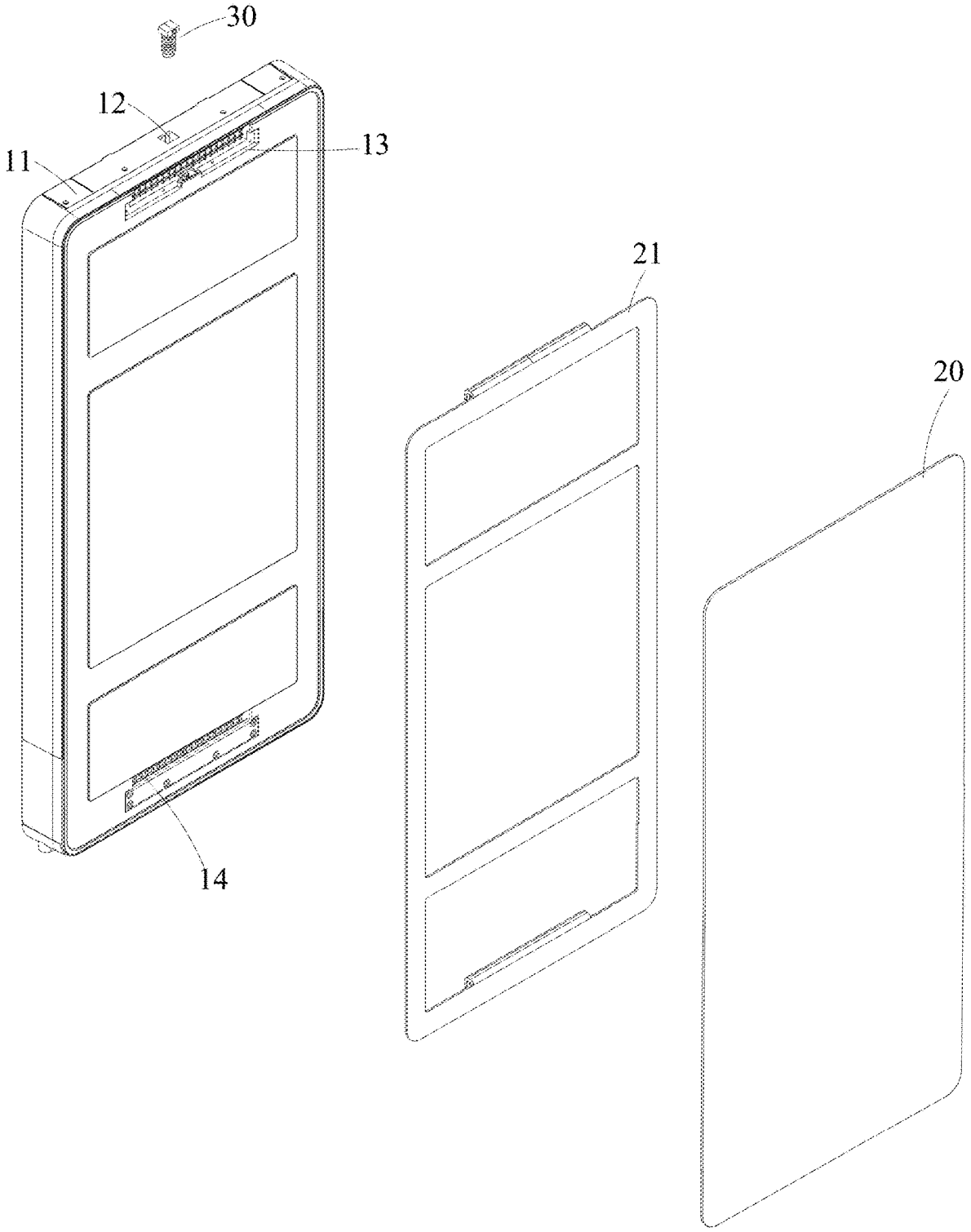
FIG. 2 and FIG. 3 are exploded views of the refrigerator door with a replaceable door panel in FIG. 1 as viewed from different angles of view.

The present invention will be described in detail below in combination with embodiments shown in the figures. However, these embodiments do not limit the present invention, and structural or functional changes made by those having ordinary skill in the art according to these embodiments are all included in the protection scope of the present invention.

As shown in FIG. 1 through FIG. 7, a refrigerator door 100 with a replaceable door panel comprises: a foam door body 10, and a decorative panel 20 detachably connected to the foam door body 10; a press latch and a limiter 141 are disposed on the foam door body 10; a first hook 22 and a second hook 23 opposed to each other are disposed on a rear side of the decorative panel 20 facing towards the foam door body 10, a lock hole 224 being disposed on the first hook 22; when the decorative panel 20 is assembled to a front side of the foam door body 10, a front end of the press latch catches the lock hole 224 to limit a displacement of the decorative panel 20 in an up-down direction; the second hook 23 engages the limiter 141 to limit the displacement of the decorative panel 20 in a front-rear direction.

Figure 6:
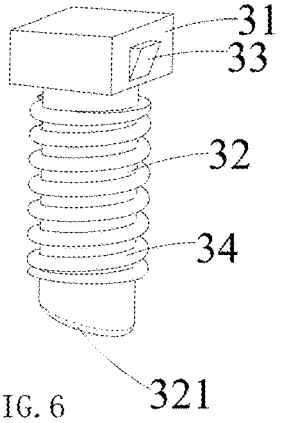
FIG. 6 is a view of a button assembly in FIG. 2.
Figure 7:
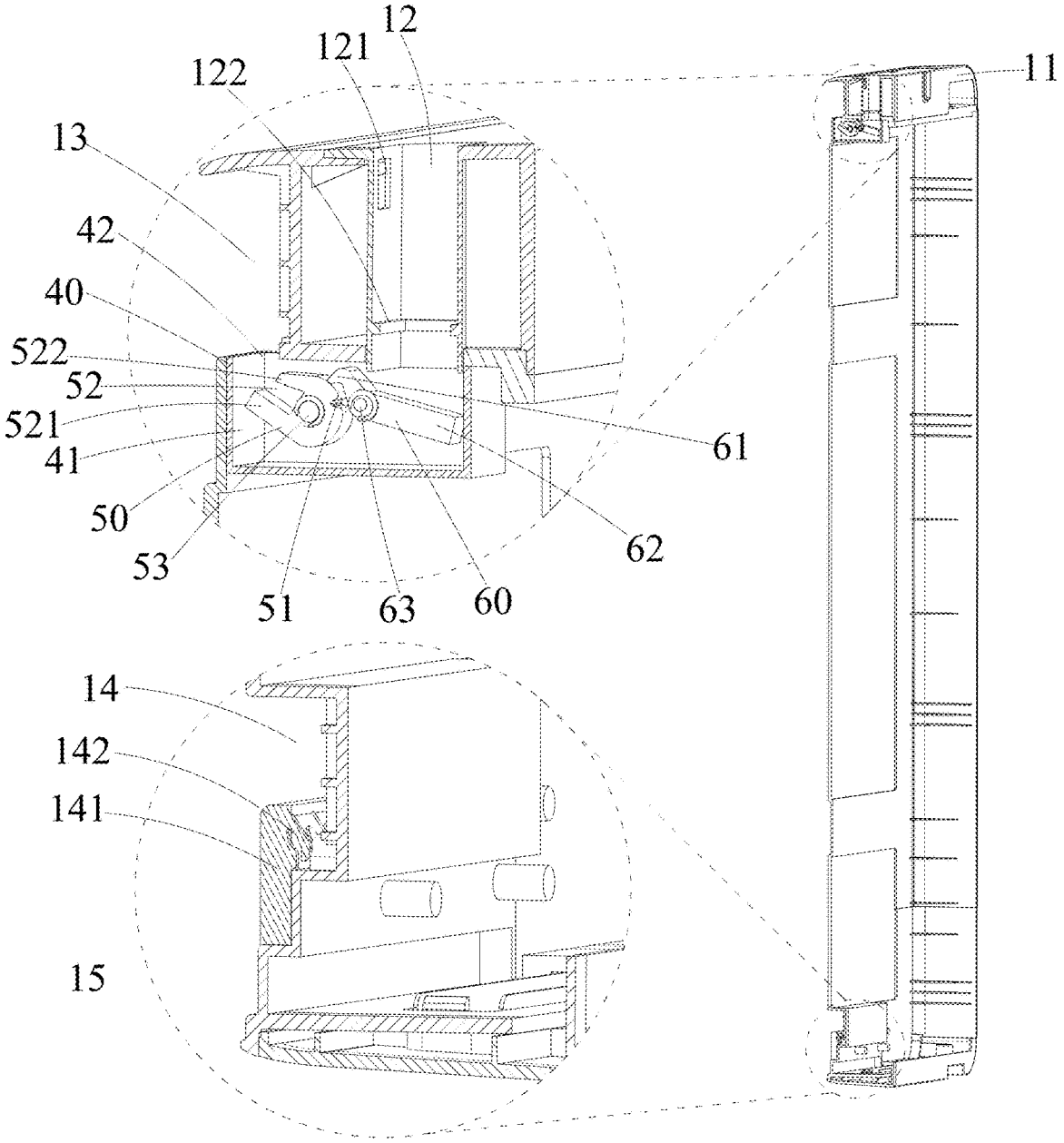
FIG. 7 is a cross-sectional view of the foam door body in FIG. 2.
Figure 8A:
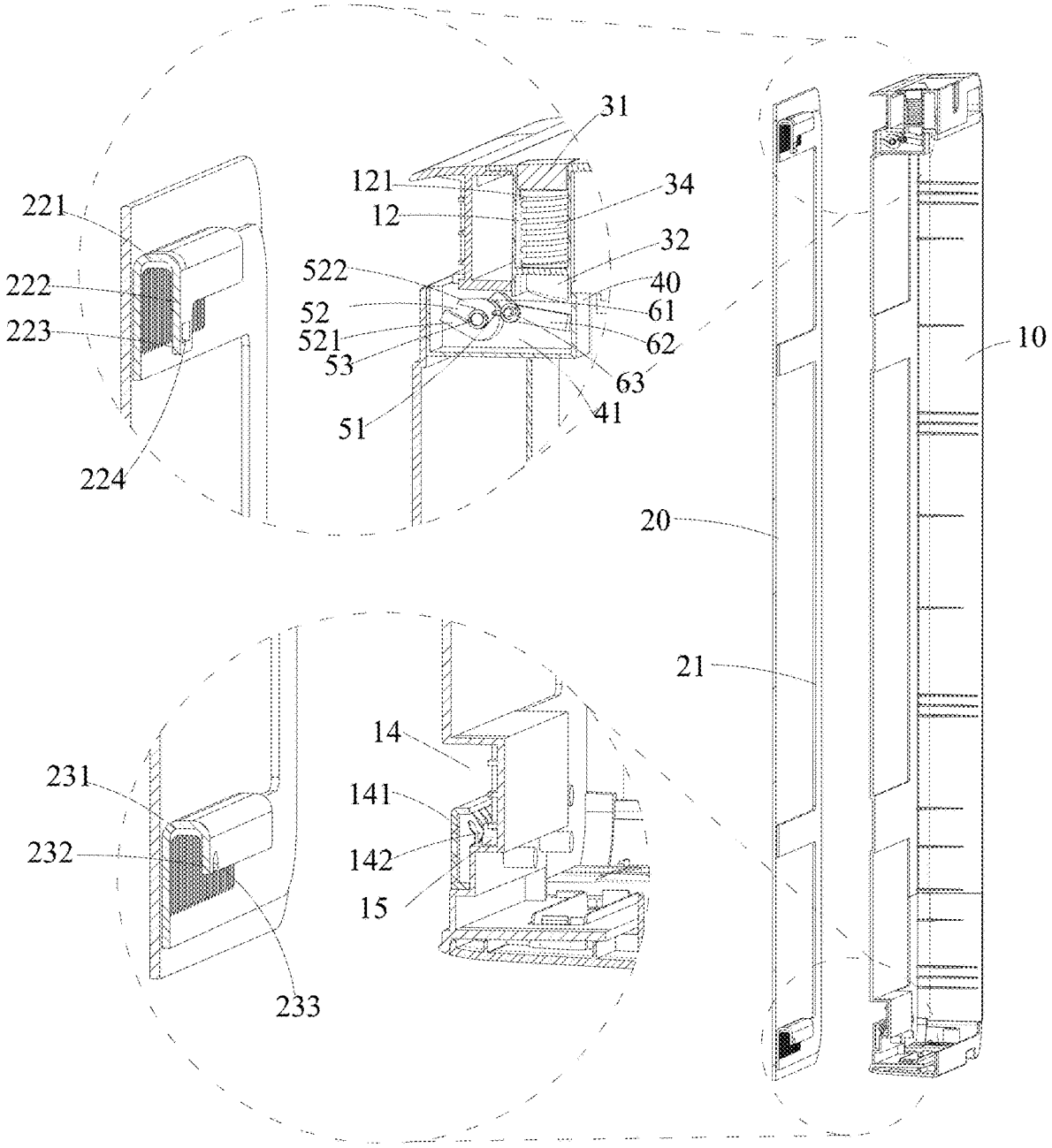
FIG. 8A through FIG. 8B are cross-sectional views of the refrigerator door with the replaceable door panel of FIG. 1 during the assembling.
Figure 8B:
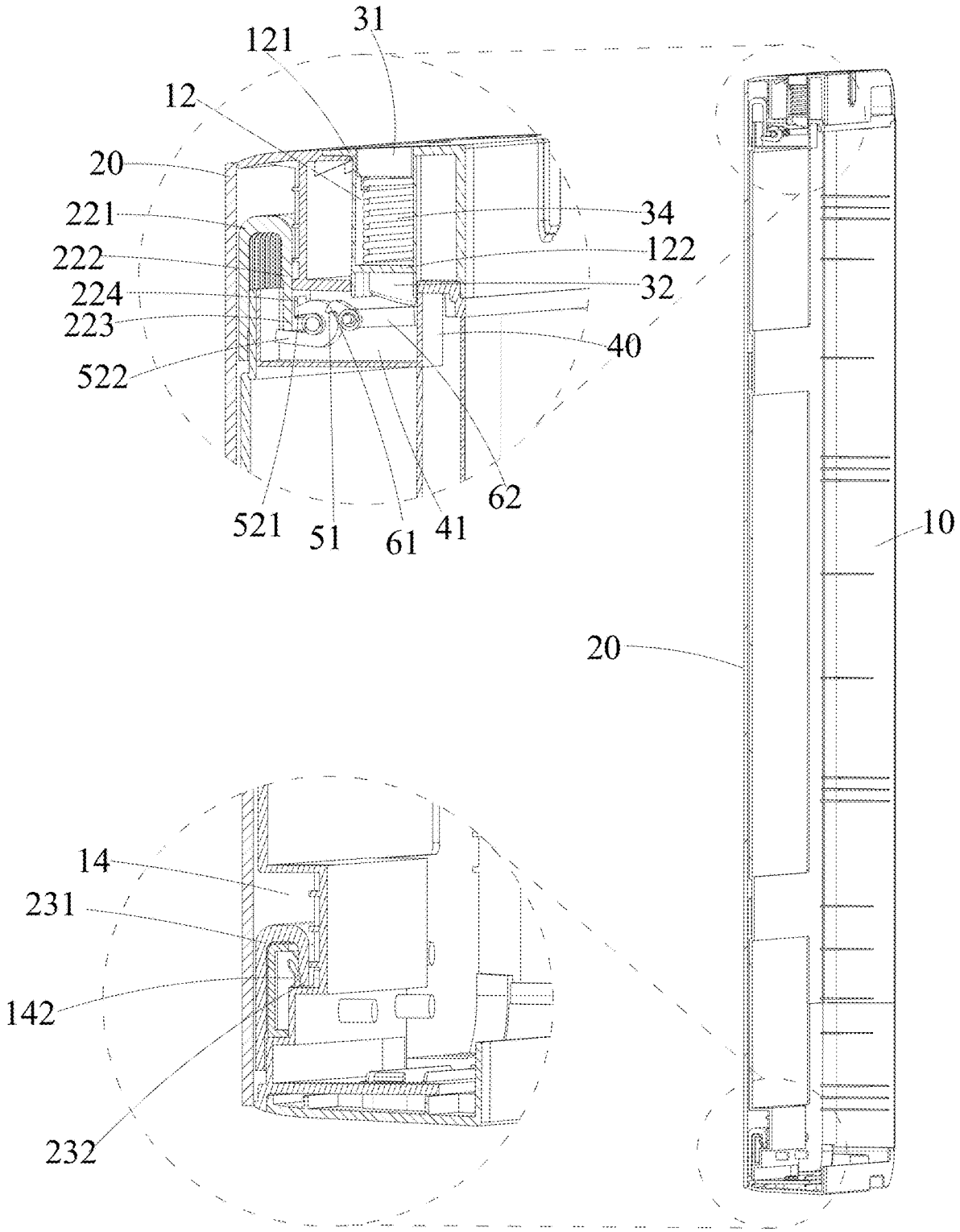
Figure 8C:
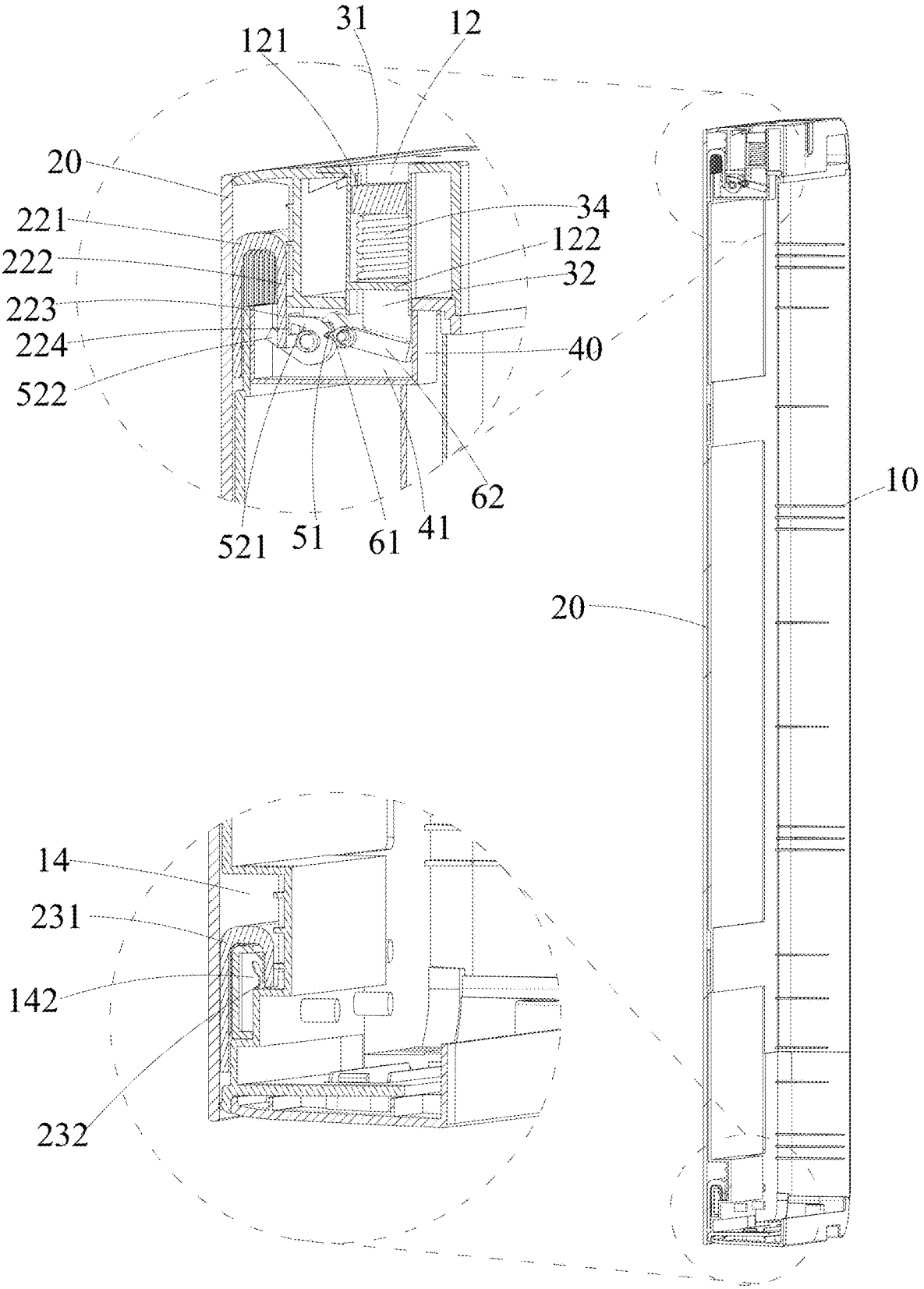
FIG. 8C is a cross-sectional view of the button assembly of the refrigerator door with the replaceable door panel of FIG. 1 when in a pressed state.

As shown in FIG. 6, FIG. 7 and FIG. 8B, the press latch comprises a button assembly 30, a first locking hook 50 and a second locking hook 60. When the button assembly 30 is in an unpressed state, the first locking hook 50 interlocks with the second locking hook 60, and a front end of the first locking hook 50 is locked in the lock hole 224; As shown in FIG. 6, FIG. 7 and FIG. 8C, when the button assembly 30 is in a pressed state, the second locking hook 60 and the first locking hook 50 are unlocked, and the front end of the first locking hook 50 disengages from the lock hole 224.

Further referring to FIG. 1 through FIG. 7, the foam door body 10 comprises a peripheral trim strip 11, a receiving hole 12 may be disposed on a side of the peripheral trim strip 11, and the button assembly 30 may be received in the receiving hole, wherein the button assembly 30 comprises a button portion 31 and a push rod portion 32, and the button portion 31 may be exposed from the receiving hole 12 to facilitate the user to press the button portion 31.

In a preferred embodiment, one of a top trim strip and a bottom trim strip of the peripheral trim strip 11 is provided with the receiving hole 12, so that the user may release the interlocking relationship between the first locking hook 50, the second locking hook 60 and the first hook 22 by pressing down or up the button portion 31, thereby facilitating the detachment of the decorative panel 20. In the present embodiment, the receiving hole 12 is disposed in the top trim strip of the peripheral trim strip 11.

As shown in FIG. 6 and FIG. 7, the button portion 31 comprises a stop 33, which protrudes from a side wall of the button portion 31; a receiving groove 121 is disposed on an inner wall of the receiving hole; wherein the button assembly 30 is received in the receiving hole 12, and the stop 33 is received in the receiving groove 121.

Furthermore, an elastic member 34 is sleeved outside the push rod portion 32 of the button assembly 30; a resisting portion 122 protrudes from the inner wall of the receiving hole 12, and the resisting portion 122 protrudes toward an interior of the receiving hole 12; when the button assembly 30 is received in the receiving hole 12, opposite ends of the elastic member 34 elastically abut against the button portion 31 and the resisting portion 122, respectively.

In the present embodiment, an end of the push rod portion 32 away from the button portion 31 protrudes from the resisting portion 122 and extends toward the second locking hook 60. After the button portion 31 is pressed, the push rod portion 32 moves toward the second locking hook 60, and the elastic member 34 is compressed between the button portion 31 and the resisting portion 122; after the button portion 31 is released, the compressed elastic member 34 extends to provide an elastic force, and the button portion 31 and the push rod portion 32 return from the pressed state to the unpressed state under action of the elastic force.

In addition, during the returning process of the button portion 31, the stop 33 slides in the receiving groove 121. After the button portion 31 returns, the stop 33 is stopped by an end groove wall (or an upper end groove wall) of the receiving groove 121 and does not move any more, thereby preventing the button portion 31 from ejecting out of the receiving hole 12 after the return and disengaging from the receiving hole 12.

As shown in FIG. 7, a box 40 is also disposed in the foam door body 10, and the box 40 may be integrally formed with the peripheral trim strip 11. An opening portion 42 is disposed on a side of the box 40 facing towards the receiving hole 12, and communicates a receiving space 41 in the interior of the box 40 with the receiving hole 12. The button portion 31 is pressed so that the push rod portion 32 extends through the opening portion 42 into the receiving space 41 and abuts against a lever portion 62 of the second locking hook 60.

The first locking hook 50 and the second locking hook 60 that may be interlocked are respectively received in the receiving space 41 in the box 40, and the first locking hook 50 and the second locking hook 60 are pivotally connected to a side wall of the box 40.

Specifically, a first rotating shaft 53 is disposed between the first locking hook 50 and the side wall of the box 40, a first torsion spring is disposed on the first rotating shaft 53, the first torsion spring is sleeved in the first rotating shaft 53, a fixe end of the torsion spring is fixed to the side wall of the box 40, and a free end of the torsion spring interacts with the first locking hook 50, wherein the first torsion spring provides a torsional force causing the first locking hook 50 to rotate around the first rotating shaft 53. A second rotating shaft 63 is disposed between the second locking hook 60 and the side wall of the box 40, a second torsion spring is disposed on the second rotating shaft 63, the second torsion spring is sleeved in the second rotating shaft 63, a fixed end of the second torsion spring is fixed to the side wall of the box 40, and a free end of the second torsion spring interacts with the second locking hook 60, wherein the second torsion spring provides a torsional force causing the second locking hook 60 to rotate around the second rotating shaft 63, and a hook 61 at a front end of the second locking hook 60 catches a hook-catching groove 51 at a rear end of the first locking hook 50.

In the present embodiment, for example, the torsion force provided by the first torsion spring causes the first locking hook 50 to rotate clockwise around the first rotating shaft 53, and then a second arm 522 of a notched slot 52 at the front end of the first locking hook 50 has a tendency to disengage from the lock hole 224; the torsional force provided by the second torsion spring causes the second locking hook 60 to rotate counterclockwise around the second rotating shaft 63, and the hook 61 at the front end of the second locking hook 60 has a tendency to catch the hook-catching groove 51.

It needs to be appreciated that when the first hook 22 is not inserted into a first hook groove 13, the first torsion spring is in a natural state (or a force-not-received state), and the second torsion spring is in a torsional state (or a force-received state). At this time, the torsional force provided by the second torsion spring causes the hook 61 at the front end of the second locking hook 60 to have a tendency to catch the hook-catching groove 51 at the rear end of the first locking hook 50.

In addition, when the first hook 22 is inserted into the first hook groove 13, an extension portion 223 presses against a first arm portion 521 by using the dead weight of the decorative panel 20 and the frame 21, the first locking hook 50 pivots around the first rotating shaft 53, and the first torsion spring is twisted. At this time, the hook 61 smoothly catches the hook-catching groove 51 by virtue of a counterclockwise acting force applied by the second torsion spring on the second locking hook 60. The first hook 22 is inserted into the first hook groove 13; after the front end of the first locking hook 50 and the lock hole 224 interlock each other, the torsion force generated by the first torsion spring is smaller than a gravitational force generated by the decorative panel 20 and the frame 21, to maintain the locked state of the first locking hook 50 and the lock hole 224. In addition, since the first locking hook 50 pivots, a direction of the torsional force generated by the first torsion spring is opposite to a direction of a pressing force by which the extension portion 223 of the first hook 22 presses against the first arm portion 521.

In addition, the button portion 31 is pressed so that the push rod portion 32 extends into the receiving space 41 and pushes against the lever portion 62 at the rear end of the second locking hook 60. A pushing force applied by the push rod portion 32 on the lever portion 62 is greater than the torsional force exerted by the second torsion spring on the second locking hook 60. The second locking hook 60 pivots around the second rotating shaft 63, the hook 61 at the front end of the second locking hook 60 is lifted upward, the hook 61 disengages from the hook-catching groove 51 at the rear end of the first locking hook 50, and the second locking hook 60 and the first locking hook 50 are unlocked. In the absence of the constraint of the second locking hook 60, the first torsion spring in the counterclockwise torsional state rotates clockwise to return to the natural state, driving the second arm portion 522 of the notched slot 52 at the front end of the first locking hook 50 to disengage from the lock hole 224, and the first hook 22 and the first locking hook 50 are unlocked. Furthermore, the limitation of the displacement of the first hook 22 and the first locking hook 50 in the up-down direction is released, the first hook 22 may be removed from the first hook groove 13, and the limitation of the displacement of the decorative panel 20 and the foam door body 10 in the up-down direction is also released.

As shown in FIG. 7, FIG. 8B and FIG. 8C, the hook-catching groove 51 is disposed at a rear end of the first locking hook 50, the hook 61 is disposed at a front end of the second locking hook 60, and the lever portion 62 extends at a rear end of the second locking hook 60; when the decorative panel 20 is assembled on the front side of the foam door body 10, and when the button assembly 30 is in the unpressed state, the hook 61 catches the hook-catching groove 51, the first locking hook 50 interlocks with the second locking hook 60, and the first locking hook 50 interlocks with the lock hole 224 of the first hook 22; when the button assembly 30 is in the pressed state, one end of the push rod portion 32 pushes against the lever portion 62, the hook 62 disengages from the hook-catching groove 51, and the first locking hook 50 and the second locking hook 60 are unlocked. When the button assembly 30 is in the pressed state, the push rod portion 32 pushes against an end face 321 of the lever portion 62 in parallel with the lever portion 62.

Figure 3:
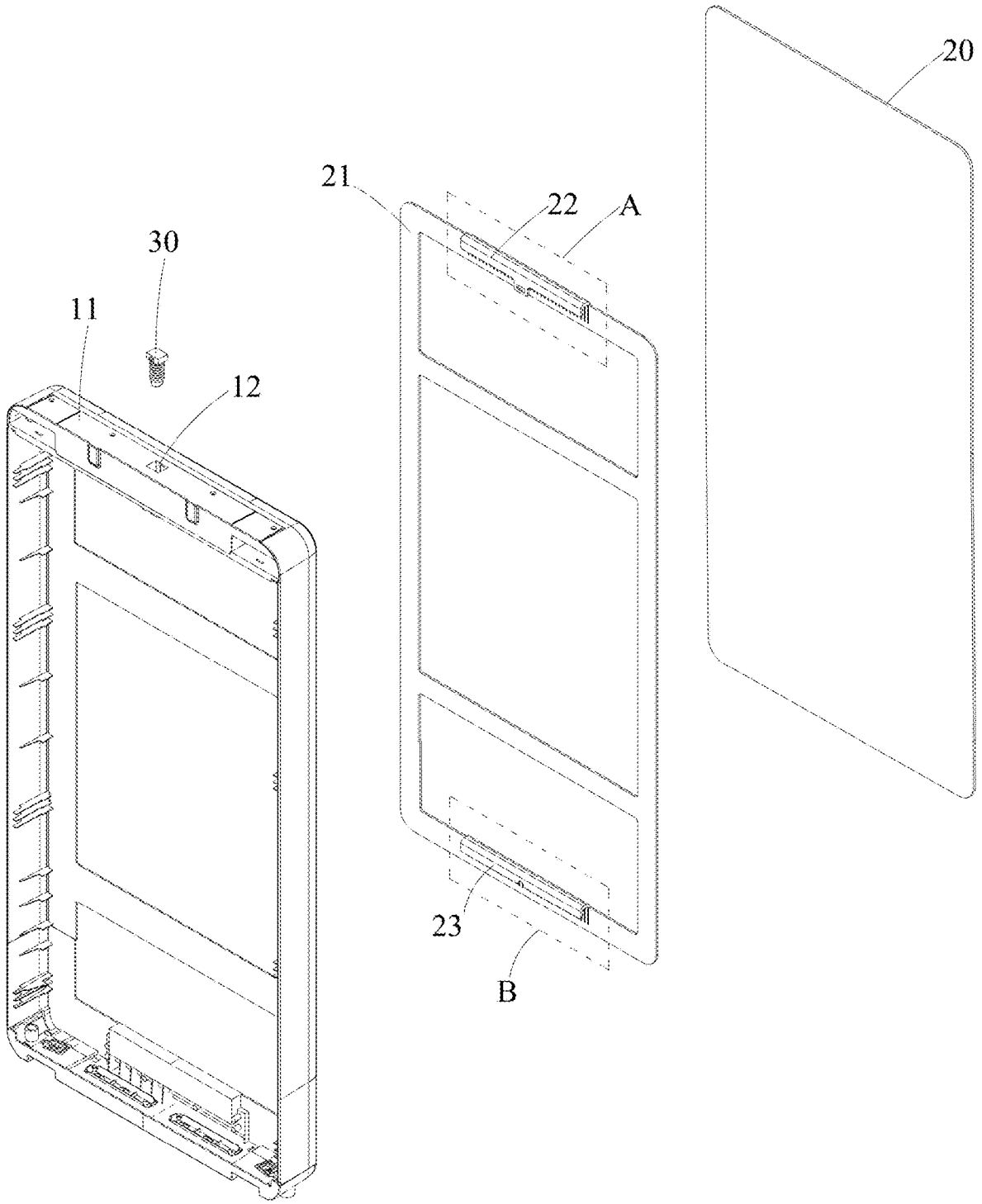
Figure 4:
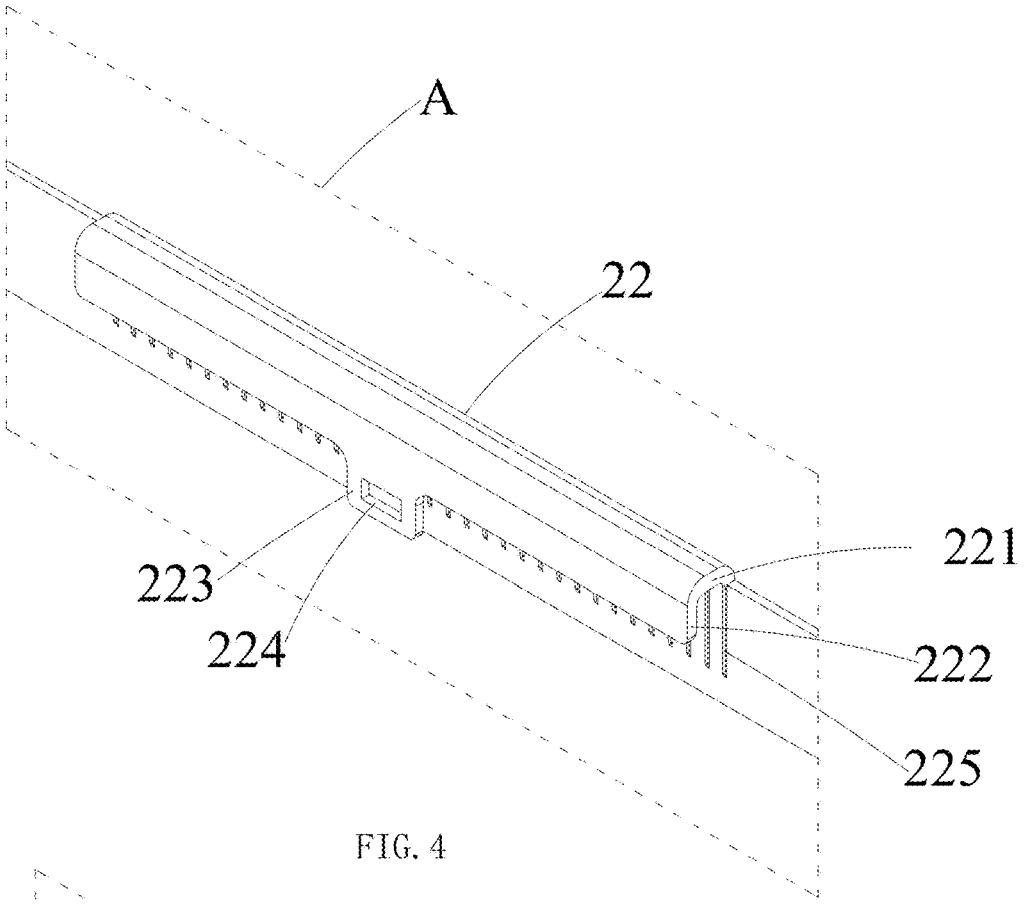
FIG. 4 and FIG. 5 are respectively enlarged views of dashed region A and dashed region B in FIG. 3.
Figure 5:
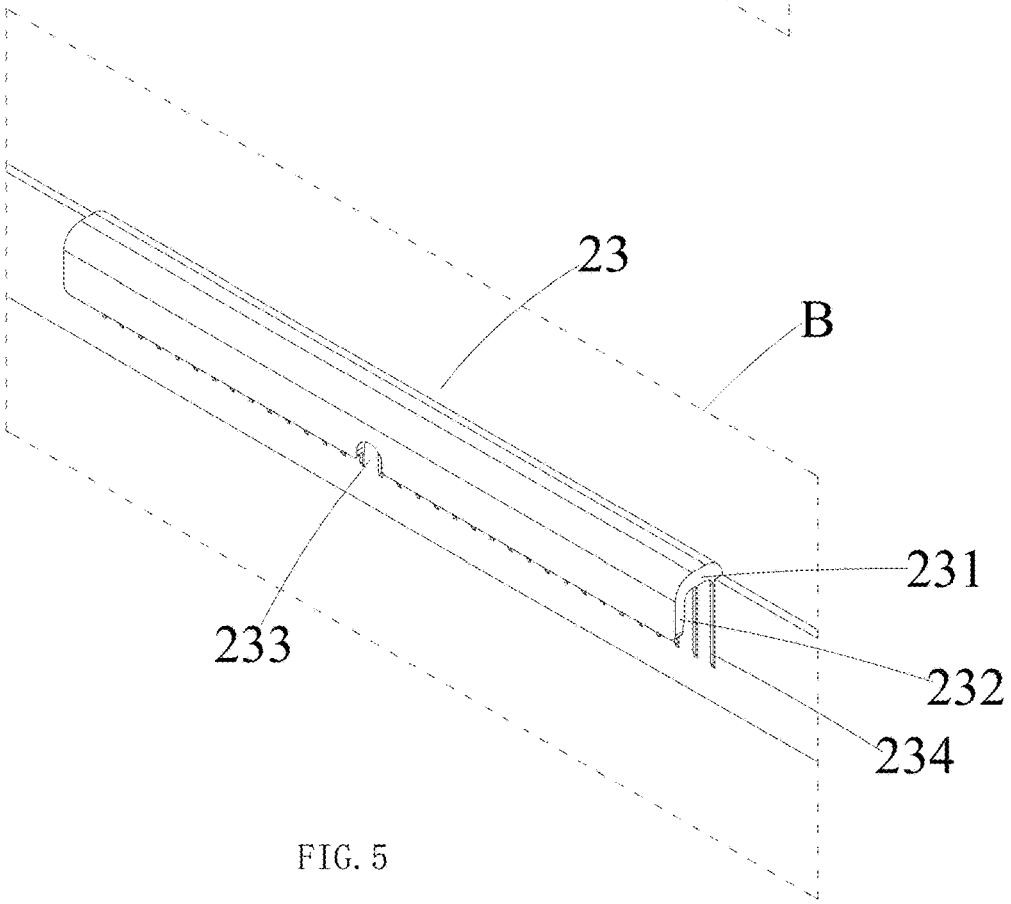

As shown in FIG. 3 through FIG. 5, a frame 21 is disposed on a rear side of the decorative panel 20, and attached and fixed to the rear side of the decorative panel 20. The frame 21 comprises a first hook 22 and a second hook 23 which are disposed oppositely. In the present embodiment, the structure of the first hook 22 is different from the structure of the second hook 23, wherein the first hook 22 is disposed close an upper end of the frame 21, and the second hook 23 is disposed close to a lower end of the frame 21. However, the positions of the first hook and second hook are not limited thereto. In other embodiments of the present invention, the first hook is disposed close to the lower end of the frame, and the second hook is disposed close to the upper end of the frame.

As shown in FIG. 4, the first hook 22 is formed by bending from the upper end of the frame 21, for example, a sheet metal structure. The first hook 22 comprises a first connecting portion 221 and a first bent portion 222. The frame 21 and the first bent portion 222 are respectively connected to opposite ends of the first connecting portion 221. The first bent portion 222 is parallel to the frame 21 and the decorative panel 20. The lower end of the first bent portion 222 comprises an extension portion 223 which is opposite to the decorative panel 20 in the front-rear direction, that is, the extension portion 223 is parallel to and opposite to the decorative panel 20, and the lock hole 224 is disposed on the extension portion 223.

As shown in FIG. 7 and FIG. 8A, corresponding to the first hook 22, the first hook groove 13 is disposed on the front side of the foam door body 10. In one embodiment, the first hook groove 13 may be formed on the peripheral trim strip 11. In the present embodiment, the box 40 is disposed at the bottom of the first hook groove 13. The interior of the first hook groove 13 is communicated with the opening portion 42 of the box 40.

With reference to FIG. 8A through FIG. 8B, when the first hook 22 is mounted in the first hook groove 13, the first hook 22 is inserted into the first hook groove 13 and moves towards the bottom of the first hook groove 13 in the up-down direction. The extension portion 223 of the first hook 22 is inserted through the opening portion 42 into the receiving space 41, the extension portion 223 presses down against the first arm portion 521 of the notched slot 52 at the front end of the first locking hook 50, the first locking hook 50 pivots, a second arm portion 522 of the notched slot 52 catches the lock hole 224, and the first hook 22 and the first locking hook 50 snap-fit each other, thereby limiting the displacement of the first hook 22 in the up-down direction, and further limiting the displacement of the decorative panel 20 in the up-down direction.

As shown in FIG. 3, FIG. 5, FIG. 7 and FIG. 8B, the rear side of the frame 21 further comprises a second hook 23, the second hook 23 comprises a second connecting portion 231 and a second bent portion 232, the lower end of the frame 21 and the second bent portion 232 are respectively disposed at opposite ends of the second connecting portion 231, and the second bent portion 232 is parallel and opposite to the decorative panel 20.

Corresponding to the second hook 23, the bottom trim strip of the peripheral trim strip 11 of the foam door body 10 is provided with a second hook groove 14, a limiting member 141 is disposed at an opening on a front side of the second hook groove 14, and a rear side of the limiting member 141 comprises an elastic resisting portion 142.

When the second hook 23 is inserted into the second hook groove 14, the elastic resisting portion 142 elastically pushes the second bent portion 232 in the front-rear direction. Preferably, the elastic resisting portion 142 elastically pushes the second bent portion 232 backward in the second hook groove 14, so that the decorative panel 20 fits on the front side of the foam door body 10. There is no gap between the decorative panel 20 and the foam door body 10, so that a more beautiful appearance is presented.

In a preferred embodiment, one end of the elastic resisting portion 142 is connected to a top end of the limiting member 141, the other end of the elastic resisting portion 142 is suspended at the lower end of the limiting member 141, and the elastic resisting portion 142 extends obliquely downward along a top end of the limiting member 141 towards a rear groove wall of the second hook groove 14.

As shown in FIG. 8A, the rear groove wall of the second hook groove 14 is disposed opposite to the limiting member 141, a positioning bump 15 is disposed on the rear groove wall, a positioning recess 233 is disposed on the second bent portion 223, wherein the second hook 23 catches the second hook groove 14, and under the elastic pushing of the elastic resisting portion 142, the positioning recess 233 and the positioning bump 15 snap-fit each other, thereby limiting the displacement of the second hook 23 in the left-right direction, so that the second hook 23 is engaged in the second hook groove 14 more stably.

In addition, in the present embodiment, the first hook 22 is provided with reinforcing ribs 225, and the second hook 23 is provided with reinforcing ribs 234, wherein the reinforcing ribs 225, 234 are respectively used to enhance a load-bearing capacity of the hooks and improve the stability of the refrigerator door.

As shown in FIG. 8A and FIG. 8B, the assembling process of the refrigerator door 100 with a replaceable door panel roughly comprises: allowing the first hook 22 and the second hook 23 of the frame 21 at the rear side of the decorative panel 20 to catch the corresponding first hook groove 13 and the second hook groove 14, respectively.

The engagement process of the first hook 22 and the first hook groove 13 is as follows: the extension portion 223 of the first hook 22 presses against the first arm portion 521 at the front end of the first locking hook 50, the first locking hook 50 pivots, the second arm portion 522 at the front end of the first locking hook 22 catches the lock hole on the extension portion 223, and the first locking hook 50 is locked with the first hook 22; the first locking hook 50 pivots, the hook-catching groove 51 at the rear end of the first locking hook 50 engages with the hook 61 at the front end of the second locking hook 60, and the first locking hook 50 is locked with the second locking hook 60;

The engagement process of the second hook 23 and the second hook groove 14 is as follows: the second hook 23 is inserted into the second hook groove 14, and pushes the decorative panel 20 to move towards the rear side of the second hook groove 14, the second hook 23 falls into the bottom of the second hook groove 14, and the elastic resisting portion 142 at the rear side of the limiting member 141 elastically pushes against the second bent portion 232 of the second hook 23.

As shown in FIG. 8C, a process of detaching the decorative panel 20 and the foam door body 10 roughly comprises:

First, the button portion 31 is pushed, the push rod portion 32 pushes against the lever portion 62 at the rear end of the second locking hook 60, the second locking hook 60 pivots around the second rotating shaft 63, the hook 62 at the front end of the second locking hook 60 disengages from the hook-catching groove 51 at the rear end of the first locking hook 50, and the interlocking of the second locking hook 60 and the first locking hook 50 is released; At this time, the first locking hook 50 pivots under the action of the first torsion spring, the second arm portion 522 of the notched slot 52 at the front end of the first locking hook 50 disengages from the lock hole 224 of the first hook 22, and the first hook 22 and the first locking hook 50 are unlocked; Next, the decorative panel 10 is moved in the up-down direction, the first hook 22 disengages from the first hook groove 13, the second hook 23 disengages from the second hook groove 14, and the decorative panel 20 is removed from the front side of the foam door body 10.

To sum up, the invention provides a decorative panel with a replaceable door panel. With the latch assembly and the limiting member 141 in the foam door body engaging the two differently-structured hooks on the rear side of the decorative panel respectively, the displacement of the decorative panel in the up-down direction and front-rear direction is limited simultaneously; since screws are not used for fixation, and instead the simple engagement structures are employed, the assembling between the decorative panel and the foam door body is stabler, the risk of the breakage of the decorative panel is smaller, and meanwhile the detachment is simpler and more convenient.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A refrigerator door with a replaceable door panel, wherein the refrigerator door comprises:

a foam door body, and a decorative panel detachably connected to the foam door body;

a press latch and a limiter are disposed on the foam door body;

a first hook and a second hook opposed to each other are disposed on a rear side of the decorative panel facing towards the foam door body, a lock hole being disposed on the first hook;

wherein when the decorative panel is assembled to a front side of the foam door body, a front end of the press latch catches the lock hole to limit a displacement of the decorative panel in an up-down direction; the second hook engages the limiter to limit a displacement of the decorative panel in a front-rear direction;

wherein the press latch comprises a button assembly, a first locking hook and a second locking hook, wherein when the button assembly is in an unpressed state, the first locking hook interlocks with the second locking hook, and a front end of the first locking hook is locked in the lock hole;

wherein the foam door body comprises a peripheral trim strip, a receiving hole is disposed in the peripheral trim strip, and the button assembly is received in the receiving hole;

wherein the button assembly comprises a button portion and a push rod portion, and the button portion is exposed from the receiving hole;

wherein the button assembly comprises a compression spring concentrically disposed around an outer circumferential surface of the push rod portion and received in the receiving hole, wherein a resisting portion protrudes from an interior of the receiving hole, and opposite ends of the compression spring elastically abut against the button portion and the resisting portion, respectively.

2. The refrigerator door with the replaceable door panel according to claim 1, wherein when the button assembly is in a pressed state, the second locking hook and the first locking hook are unlocked, and the front end of the first locking hook disengages from the lock hole.

3. The refrigerator door with the replaceable door panel according to claim 1, wherein the button portion comprises a stop, a receiving groove is disposed in the receiving hole, wherein when the button assembly is in the unpressed state, the stop is received in the receiving groove.

4. The refrigerator door with the replaceable door panel according to claim 1, wherein a box is disposed in the foam door body, an opening portion of the box is opened at a side of the box to provide a spatial access from the receiving hole to a receiving space defined in an interior of the box, and the first locking hook and the second locking hook are assembled in the receiving space.

5. The refrigerator door with the replaceable door panel according to claim 4, wherein a lower end of the first hook comprises an extension portion which is opposite to the decorative panel in the front-rear direction, and the lock hole is disposed on the extension portion; wherein the first hook is inserted through the opening portion into the receiving space in the up-down direction, and the lock hole is locked with the front end of the first locking hook.

6. The refrigerator door with the replaceable door panel according to claim 1, wherein a hook-catching groove is disposed at a rear end of the first locking hook, a catch hook is disposed at a front end of the second locking hook, and a lever portion extends at a rear end of the second locking hook; when the button assembly is in the unpressed state, the catch hook catches the hook-catching groove, and the first locking hook interlocks with the second locking hook; when the button assembly is in the pressed state, the push rod portion pushes against the lever portion, the catch hook disengages from the hook-catching groove, and the first locking hook and the second locking hook are unlocked.

7. The refrigerator door with the replaceable door panel according to claim 6, wherein when the button assembly is in the pressed state, the push rod portion pushes against an end face of the lever portion in parallel with the lever portion.

8. The refrigerator door with the replaceable door panel according to claim 6, wherein a front end of the first locking hook comprises a notched slot, the notched slot has a first arm portion at a first end of the notched slot and a second arm portion at a second end of the notched slot that is opposite to the first end of the notched slot, wherein the first locking hook pushes down the first arm portion, and the second arm portion catches the lock hole.

9. The refrigerator door with the replaceable door panel according to claim 8, wherein a first rotating shaft is disposed between the first locking hook and a side wall of the box in the foam door body, a first torsion spring is disposed on the first rotating shaft, wherein the first torsion spring drives the first locking hook to rotate about the first rotating shaft, and the second arm portion disengages from the lock hole; and a second rotating shaft is disposed between the second locking hook and the box, a second torsion spring is disposed on the second rotating shaft, the second torsion spring drives the second locking hook to rotate about the second rotating shaft, and the catch hook catches the hook-catching groove.

10. A refrigerator door with a replaceable door panel, wherein the refrigerator door comprises:

a foam door body, and a decorative panel detachably connected to the foam door body;

a press latch and a limiter are disposed on the foam door body;

a first hook and a second hook opposed to each other are disposed on a rear side of the decorative panel facing towards the foam door body, a lock hole being disposed on the first hook;

wherein when the decorative panel is assembled to a front side of the foam door body, a front end of the press latch catches the lock hole to limit a displacement of the decorative panel in an up-down direction; the second hook engages the limiter to limit a displacement of the decorative panel in a front-rear direction;

wherein the press latch comprises a button assembly, a first locking hook and a second locking hook, wherein when the button assembly is in an unpressed state, the first locking hook interlocks with the second locking hook, and a front end of the first locking hook is locked in the lock hole;

wherein the foam door body comprises a peripheral trim strip, a receiving hole is disposed in the peripheral trim strip, and the button assembly is received in the receiving hole; wherein the button assembly comprises a button portion and a push rod portion, and the button portion is exposed from the receiving hole;

wherein a box is disposed in the foam door body, an opening portion of the box is opened at a side of the box to provide a spatial access from the receiving hole to a receiving space defined in an interior of the box, and the first locking hook and the second locking hook are assembled in the receiving space.

11. The refrigerator door with the replaceable door panel according to claim 10, wherein the button portion comprises a stop, a receiving groove is disposed in the receiving hole, wherein when the button assembly is in the unpressed state, the stop is received in the receiving groove.

12. The refrigerator door with the replaceable door panel according to claim 10, wherein a lower end of the first hook comprises an extension portion which is opposite to the decorative panel in the front-rear direction, and the lock hole is disposed on the extension portion; wherein the first hook is inserted through the opening portion into the receiving space in the up-down direction, and the lock hole is locked with the front end of the first locking hook.

13. The refrigerator door with the replaceable door panel according to claim 10, wherein a hook-catching groove is disposed at a rear end of the first locking hook, a catch hook is disposed at a front end of the second locking hook, and a lever portion extends at a rear end of the second locking hook; when the button assembly is in the unpressed state, the catch hook catches the hook-catching groove, and the first locking hook interlocks with the second locking hook; when the button assembly is in the pressed state, the push rod portion pushes against the lever portion, the catch hook disengages from the hook-catching groove, and the first locking hook and the second locking hook are unlocked.

14. The refrigerator door with the replaceable door panel according to claim 13, wherein a front end of the first locking hook comprises a notched slot, the notched slot has a first arm portion at a first end of the notched slot and a second arm portion at a second end of the notched slot that is opposite to the first end of the notched slot, wherein the first locking hook pushes down the first arm portion, and the second arm portion catches the lock hole.

15. A refrigerator door with a replaceable door panel, wherein the refrigerator door comprises:

a foam door body, and a decorative panel detachably connected to the foam door body;

a press latch and a limiter are disposed on the foam door body;

a first hook and a second hook opposed to each other are disposed on a rear side of the decorative panel facing towards the foam door body, a lock hole being disposed on the first hook;

wherein when the decorative panel is assembled to a front side of the foam door body, a front end of the press latch catches the lock hole to limit a displacement of the decorative panel in an up-down direction; the second hook engages the limiter to limit a displacement of the decorative panel in a front-rear direction;

wherein the press latch comprises a button assembly, a first locking hook and a second locking hook, wherein when the button assembly is in an unpressed state, the first locking hook interlocks with the second locking hook, and a front end of the first locking hook is locked in the lock hole;

wherein the foam door body comprises a peripheral trim strip, a receiving hole is disposed in the peripheral trim strip, and the button assembly is received in the receiving hole; wherein the button assembly comprises a button portion and a push rod portion, and the button portion is exposed from the receiving hole;

wherein a hook-catching groove is disposed at a rear end of the first locking hook, a catch hook is disposed at a front end of the second locking hook, and a lever portion extends at a rear end of the second locking hook; when the button assembly is in the unpressed state, the catch hook catches the hook-catching groove, and the first locking hook interlocks with the second locking hook; when the button assembly is in the pressed state, the push rod portion pushes against the lever portion, the catch hook disengages from the hook-catching groove, and the first locking hook and the second locking hook are unlocked.

16. The refrigerator door with the replaceable door panel according to claim 15, wherein the button portion comprises a stop, a receiving groove is disposed in the receiving hole, wherein when the button assembly is in the unpressed state, the stop is received in the receiving groove.

17. The refrigerator door with the replaceable door panel according to claim 15, wherein when the button assembly is in the pressed state, the push rod portion pushes against an end face of the lever portion in parallel with the lever portion.

18. The refrigerator door with the replaceable door panel according to claim 15, wherein a front end of the first locking hook comprises a notched slot, the notched slot has a first arm portion at a first end of the notched slot and a second arm portion at a second end of the notched slot that is opposite to the first end of the notched slot, wherein the first locking hook pushes down the first arm portion, and the second arm portion catches the lock hole.

19. The refrigerator door with the replaceable door panel according to claim 18, wherein a first rotating shaft is disposed between the first locking hook and a side wall of the box in the foam door body, a first torsion spring is disposed on the first rotating shaft, wherein the first torsion spring drives the first locking hook to rotate about the first rotating shaft, and the second arm portion disengages from the lock hole; and a second rotating shaft is disposed between the second locking hook and the box, a second torsion spring is disposed on the second rotating shaft, the second torsion spring drives the second locking hook to rotate about the second rotating shaft, and the catch hook catches the hook-catching groove.

* * * * *